US005295557A

United States Patent [19]

Taylor

[11] Patent Number: 5,295,557

[45] Date of Patent: Mar. 22, 1994

[54] UTILITY CONSTRUCTION SAFETY AND WORK PLATFORM

[76] Inventor: George E. Taylor, P.O. Box 3633, Capitol Heights, Md. 20791

[21] Appl. No.: 836,564

[22] Filed: Feb. 18, 1992

[51] Int. Cl.[5] ..... E04G 3/14

[52] U.S. Cl. ..... 182/222; 182/113; 182/128

[58] Field of Search ..... 182/222, 128, 113; 52/20

[56] References Cited

U.S. PATENT DOCUMENTS

| | | | |
|---|---|---|---|
| 1,163,798 | 12/1915 | Williams . | |
| 1,370,166 | 3/1921 | Thiel | 182/128 |
| 2,393,126 | 1/1946 | Stevenson | 256/25 |
| 2,623,643 | 12/1952 | Seamans | 182/128 |
| 3,426,659 | 2/1969 | Clarke et al. | 182/128 |
| 4,323,140 | 4/1982 | Foscarini et al. | 182/187 |
| 4,407,392 | 10/1983 | Lazzari | 182/187 |
| 4,973,191 | 11/1990 | Dannhauser | 52/20 |

*Primary Examiner*—Alvin C. Chin-Shue

*Attorney, Agent, or Firm*—Richard C. Litman

[57] ABSTRACT

A safety and work platform is attachable to the top of a manhole casing during utility construction and provides for the safety of workers or persons upon the top of the casing. The platform provides for positive anchoring to the top of the casing with at least three securing points, at least one of which provides adjustability, and may include peripheral stanchions and guard rail for further protection. The interior of the casing is accessible through a an opening int he platform floor, which opening may be covered for safety when not in use. For additional safety, a belt and lanyard system may be used to secure a worker or other person to the platform. A method of use is also disclosed, with the platform first being installed upon a manhole casing and then the casing and platform lifted into position and installed together in order to preclude any persons from standing atop the casing before the platform is installed. When the necessary survey or other work has been completed, the platform may be removed for storage or other use.

14 Claims, 2 Drawing Sheets

UTILITY CONSTRUCTION SAFETY AND WORK PLATFORM

FIELD OF THE INVENTION

This invention relates generally to safety equipment for use with construction projects, and more specifically to a temporarily installable and removable safety and work platform attachable to the rim of a prefabricated manhole casing or utility opening during construction.

BACKGROUND OF THE INVENTION

In the field of utility construction, many electrical, sewage, gas and other utilities are buried underground. Access for such buried utilities is commonly provided by means of generally on grade access openings, usually known as manholes.

During the construction phase, after trenches have been excavated for the placement of such utilities, the generally prefabricated pipes, tunnels and casings for such utilities are installed. At various points an access opening or manhole casing will be installed in the pipe or tunnel. Of course once construction is completed the upper rim of such a manhole will preferably be at or very close to the surrounding grade, but during the construction phase the manhole casing will obviously extend several feet above the bottom of the utility trench.

This has proven to be advantageous for the purpose of ongoing survey and other work during construction, as the top of the manhole casing provides a relatively unobstructed view for alignment, leveling, etc. However, the bare rim of such a casing top provides little in the way of support for a person or persons working thereupon, even with a cover temporarily installed over the opening. Further, such a structure fails to provide the necessary means for the stabilization of any survey instruments which may be used atop the structure. Obviously, such a position atop the rim of an above grade manhole casing cover is precarious, particularly when the rim may be several feet above the surface of the base of the trench, and regulations generally prohibit or strictly control such activities.

The need arises for a safety and work platform which may be temporarily installed upon and secured to the upper rim of a prefabricated utility access opening or manhole casing during the construction of utilities and the like. The platform must be capable of being securely attached to the top of such a manhole casing or the like in order to provide safe support for one or more workers, as well as to provide a steady base for a transit or similar instrument. The platform must further meet and comply with any regulations which may govern such construction activities.

DESCRIPTION OF THE RELATED ART

L. F. Williams U.S. Pat. No. 1,163,798 issued Dec. 14, 1915 discloses an Apparatus For Constructing Concrete Silos And The Like. The device basically comprises a windlass which may be attached to the top of a silo under construction, and as such is not closely related to the present invention.

F. Thiel U.S. Pat. No. 1,370,166 issued Mar. 1, 1921 discloses a Means And Method For Building Silos. This device is more closely related to scaffolding and the like than to a platform installed atop an existing completed structure, as in the present invention.

W. W. Stevenson U.S. Pat. No. 2,393,126 issued Jan. 15, 1946 discloses a Manhole Guard which serves as a barrier and cover for an on grade manhole. The device does not provide protection for persons atop the rim of such a manhole to prevent their falling from the rim to a surrounding lower trench or the like, but rather serves to prevent persons or objects outside the area from falling into the manhole.

J. W. Seamans U.S. Pat. No. 2,623,643 issued Dec. 30, 1952 discloses a Scaffold Raiser And Remover. The device is more closely related to the device of the Williams patent discussed above, rather than to the present invention. Circumferential scaffolding is disclosed around a silo, however.

A. Foscarini et al. U.S. Pat. No. 4,323,140 issued Apr. 6, 1982 discloses a Safety Landing for use in a vertical shaft, such as a manhole. The device serves essentially the same purpose as a cover or grate to prevent persons from falling in, but is installable within the manhole below the upper rim. Further, the device requires the permanent installation of support structure within the manhole casing.

Finally, W. B. Lazzari U.S. Pat. No. 4,407,392 issued Oct. 4, 1983 discloses a Safety Scaffold For Metal Melting Furnaces. The device includes ductwork for the removal of fumes from the furnace, and rests upon the top wall of the furnace with no means provided for positively securing it to the furnace wall.

None of the above noted patents, either singly or in combination, are seen to disclose the specific arrangement of concepts disclosed by the present invention.

SUMMARY OF THE INVENTION

By the present invention, an improved safety and work platform for use during the construction of utilities and the like is disclosed.

Accordingly, one of the objects of the present invention is to provide an improved safety and work platform which may be placed atop a prefabricated manhole casing or the like.

Another of the objects of the present invention is to provide such a safety and work platform which may be used in combination with such a manhole casing above grade, in order to prevent persons atop such a platform from falling outward from the top of the casing.

Yet another of the objects of the present invention is to provide such a safety and work platform which may be temporarily and positively secured to the top of such a manhole casing, and easily removed when desired.

Still another of the objects of the present invention is to provide such a safety and work platform which may include a temporarily installable and removable covered central opening.

A further object of the present invention is to provide such a safety and work platform which includes a safety railing or the like around the outer circumference.

An additional object of the present invention is to provide such a safety and work platform which provides for safety harnesses for persons atop the platform.

Yet another of the objects of the present invention is to provide such a safety and work platform which provides a rigid mount or attachment for any survey or other instruments which may be used thereupon.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
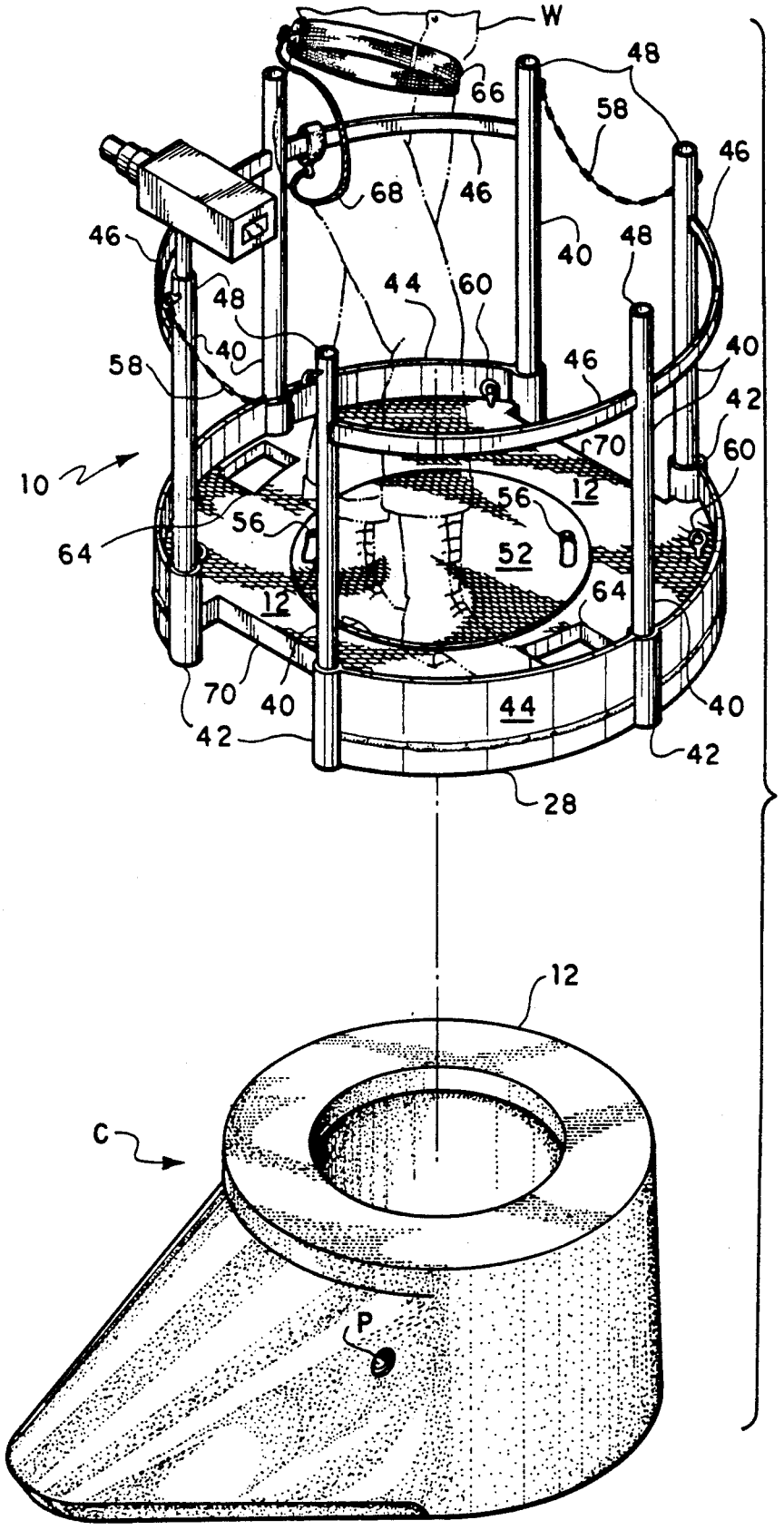
FIG. 1 is a top and side perspective view of the platform of the present invention, showing its installation upon a prefabricated manhole casing.

Referring now to the drawings, particularly FIG. 1 of the drawings, the present invention will be seen to relate to a platform for use by persons in the utility construction field or the like, which platform is temporarily securable to the top of a manhole casing. Platform 10 provides an essentially planar floor 12, the underside 14 of which may be placed atop and in contact with the upper rim R of a manhole casing C or the like. Floor 12 is preferably provided with some form of non skid surface, such as a "diamond plate" pattern or other means. While platform 10 may be constructed in a circular planform with a concentric opening 50 as shown in the drawings, such a platform 10 may be constructed in virtually any planar shape with the opening positioned as desired.

Figure 2:
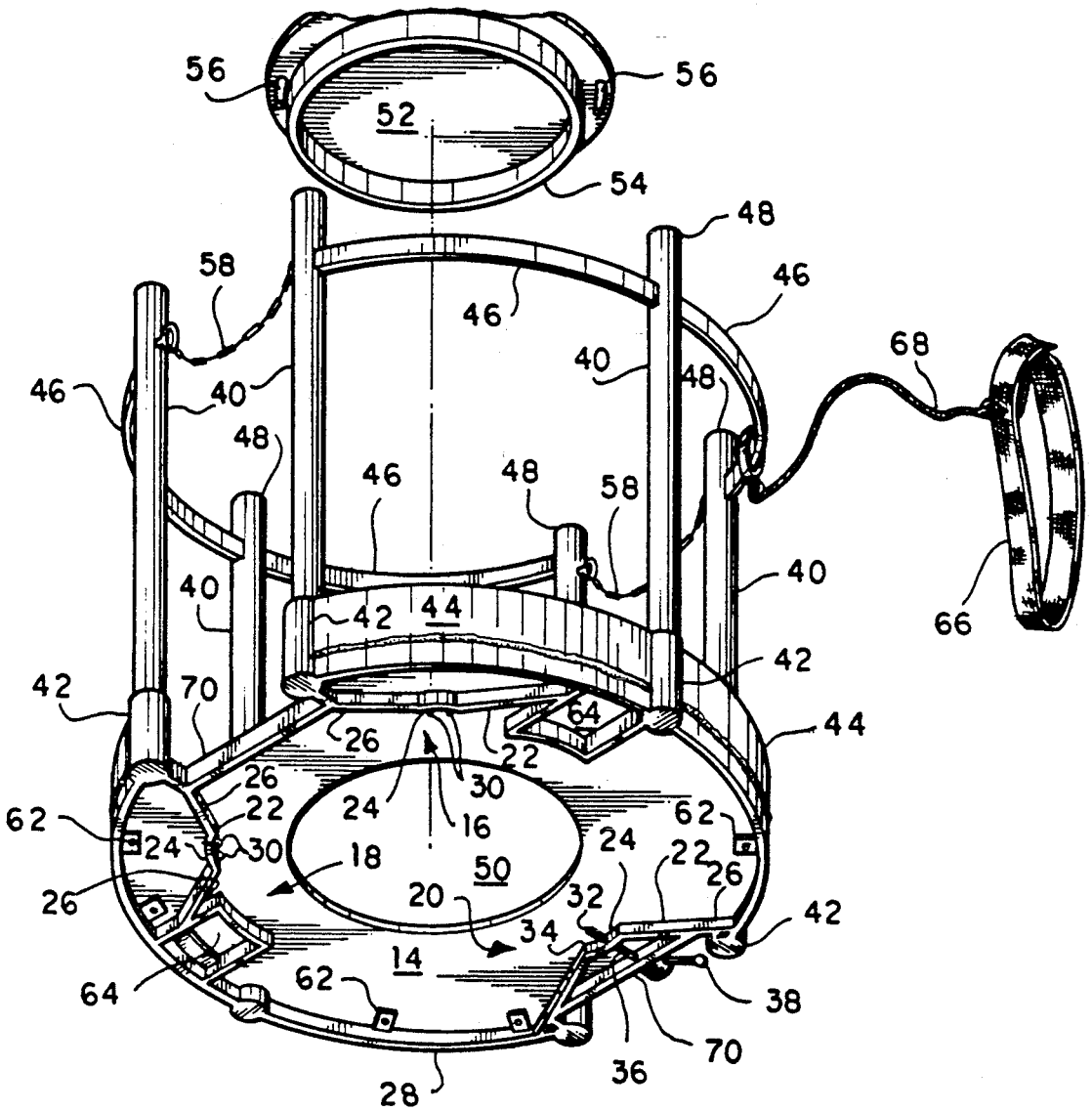
FIG. 2 is a bottom and side perspective view of the platform of the present invention, showing details of the installation means.

Platform 10 may be positively secured to the rim R of a casing C by means of a three point attachment system adjacent the floor underside 14, more clearly shown in FIG. 2. It is a well known axiom in geometry that three non linear points may serve to define a plane; thus the three point attachment system of platform 10 may be used to secure platform 10 to the exterior of the plane defined by the rim R of casing C. While casing rim R may generally be circular in form, it will be seen that the three attach points 16, 18 and 20 provided are readily adaptable to a fairly wide variation from a circular shape. It will be seen that the first and second attachment points 16 and 18 are fixed, while the third attachment point 20 provides for final adjustment and secure attachment of platform 10 to a casing C.

Each attachment point 16, 18 and 20 is generally formed of a band 22 secured to the floor underside 14, and having a midpoint 24 extending inward toward the center of platform 10. The outer ends 26 of bands 22 are further secured to a lower peripheral rim 28 extending below the edge of floor 12. Fixed attachment points 16 and 18 each have one or more pins 30, which pins 30 will be urged into gripping contact with the sides of a casing C immediately below the rim R when platform 10 is so installed. Adjustable attachment point 20 provides a threadibly adjustable pin 32 which cooperates with a threaded fitting 34 at the center 24 of adjustable fitting 20. Threaded pin 32 has an extension 36 passing outward from attachment point 20 and includes a handle 38 for leverage when using adjustable attach point 20 for securing platform 10.

Platform 10 is further equipped with a plurality of stanchions 40 which extend upward from the rim 28 of platform 10. Stanchions 40 may be temporarily installed along the rim 28 of platform 10 by means of cooperating sockets 42 or alternative means (e.g., bolts) in order to provide for more compact storage when platform 10 is not in use, or alternatively one or more of stanchions 40 may be welded or otherwise permanently and rigidly secured to the remainder of platform 10 in order to preclude any play or movement of the top of a stanchion 40 relative to the remainder of platform 10. Additional strength and rigidity are provided by means of a peripheral toeboard 44 to which sockets 42 or stanchions 40 may be attached, which toeboard 44 further serves to provide greater security for a worker W or person atop platform 10 by precluding the slippage of such a person's foot over the outer periphery of platform 10.

Peripheral guards 46 are installed between stanchions 40, thus providing additional safety for a worker W or other person atop platform 10. Guards 46 may be temporarily secured in place to the upper ends 48 of stanchions 40 using bolts or other means, or alternatively guards 46 may be permanently secured to stanchion 40 upper ends 48 by welding or other suitable means. Additional security for a worker W or other person is provided by means of a lanyard L and safety belt S by which a worker W or other person may secure themselves to a guard 46 or stanchion 40 in order to prevent a fall within the casing access opening 50 within floor 12 of platform 10. However, a cover 52 is provided for opening 50 for those times when access to the interior of manhole casing C is not required. Cover 52 may be made with a periphery slightly larger than that of opening 50, with a flange 54 or other means provided to secure cover 52 within opening 50. Slots 56 or other means may be included with cover 52 to provide means for lifting cover 52 from casing access opening 50. Access to platform 10 is provided by means of security chains 58 or other openable closure between two adjacent stanchions 40.

The concern discussed above for the rigidity of the various components of platform 10 is due to one of the operations which may be carried out atop platform 10. One of the primary reasons for such a platform 10 is to provide a secure place with relatively clear lines of sight for alignment, leveling and other survey work. It will be appreciated that the top of a manhole casing C, which is further installed atop an opening in a conduit, pipe or the like in an open trench, provides a relatively clear field of view for such survey work. Often, a worker W or surveyor will use the top of such a casing C to temporarily position a laser survey instrument S, transit or the like in order to accurately determine the alignment and drop of the utility line being constructed, perhaps for other survey work related to the surrounding site as well. The present invention provides not only for a stable and safe platform for any worker W or surveyor who might have need of such a site, but also provides for a relatively rigid and immobile mount for a survey instrument by means of the provision for rigid and permanent attachment of the stanchions 40 to the remainder of platform 10. Thus, a survey instrument S may be secured to the top of a stanchion 40 by means of a pin (not shown) inserted within the top of the hollow stanchion tube 40, or any other suitable means. It will be understood that such survey work may also be carried out using a platform 10 with removable stanchions 40 and peripheral guards 46; however, greater care must be given to providing a rigid and immobile mount for a survey instrument S under such conditions.

The preferred embodiment of platform 10 will be constructed of aluminum and/or steel components secured together to form the present invention. Even so, it will be realized that such a platform 10 will be relatively heavy and that mechanical rather than manual means will be preferred for the installation of platform 10 to the top of a casing C. Accordingly, lift rings 60 are installed through the floor 12 of platform 10; lift rings 60 are further secured to the underside 14 of floor 12 by means of reinforcements 62. By means of lift rings 60, platform 10 may be hoisted by a crane or other means to the top of a manhole casing C and installed thereupon.

Normally, platform 10 will be installed atop casing C before casing C is installed atop its respective pipe or other intended location. In this way, the upper rim R of casing C will be provided with a safety platform 10 from the moment casing C is installed. Platform 10 may be installed and adjusted atop casing C in order to position the two fixed attachment points 16 and 18 with their respective pins 30 in contact with the outside surface of casing C, immediately below the upper rim R. Pin 33 at adjustable attach point 20 may then be secured by threading pin 32 into contact against the surface of casing C, using handle 38 for leverage to provide a secure attachment for platform 10 atop casing C.

Generally, such casings C are provided with lift attach points P aligned with the approximate vertical center of gravity, for the attachment of lifting means (not shown) to hoist such a casing C into position. Such casings C will generally weigh from two to three tons; thus, the entire assembly of platform 10 and casing C cannot be lifted solely by means of the lifting rings 60 provided with platform 10. With platform 10 already installed atop a casing C prior to the installation of casing C, means must be provided for the lifting cables or the like (not shown) to clear platform 10 as the assembly of platform 10 and casing C is hoisted into position. Clearance openings 64 through the floor 12 of platform 10 serve to permit any lifting cables or the like to pass upward through the floor 12 of platform 10 as the assembly is lifted into position.

Platform 10 is used by first installing platform 10 atop a casing C as described above, and then lifting the assembly of platform 10 and casing C into the desired position. While casing C could be installed first and platform 10 later installed atop casing C, such a procedure might comprise safety somewhat in that the upper rim R of casing C would provide an unprotected area until platform 10 was installed.

A worker W or other person may then release the chain 58 or other security means and step aboard platform 10, securing chain 58 behind him or her. Two recesses 70 are located at opposite edges of platform 10, providing for the temporary installation of a ladder (not shown) for access to platform 10 by a worker W. The sides of recesses 70 serve to prevent the lateral slippage of a ladder which may be installed within any recess 70. For further safety cover 52 may be installed over casing access opening 50, either before the installation of platform 10 atop casing C or sometime thereafter. Additionally, a worker W or other person may wear a safety belt or harness 66 secured to peripheral guards 46 or stanchions 40 by means of a lanyard 68 for even greater safety if desired. Such additional safety measures as belt or harness 66 and lanyard 68 may in fact be required by regulation or policy in many situations. If survey work is to be performed, a survey instrument S may be installed upon the upper end 48 of a stanchion 40, which stanchion 40 is constructed to provide a rigid and immobile mount for such a survey instrument S relative to the remainder of platform 10. Thus, survey and other work may be easily and safely accomplished using the present invention during such utility construction.

In the event that entry within casing C and/or adjacent pipes is necessary, cover 52 may be easily removed by means of slots 56 or other lifting means in cover 52. Obviously, cover 52 may be removed and installed as necessary, depending upon the nature of the work to be accomplished.

When the use of platform 10 is no longer required at that point, removal is easily accomplished by again attaching lifting means to lifting rings 60, loosening adjustable pin 32 at adjustable attach point 20, and lifting platform 10 from the upper rim R of casing C. In the event that stanchions 40 and peripheral guards 46 have been made removable, they may be removed if desired in order to provide for more compact storage for platform 10.

It is to be understood that the present invention is not limited to the sole embodiment described above, but encompasses any and all embodiments within the scope of the following claims.

I claim:

1. A temporarily installable and removable safety and work platform for use with a manhole casing having an upper rim, an interior, and an outer surface, said platform including a floor having an outer perimeter, said floor including an opening for access to the interior of the casing, said platform including at least three attachment points disposed in a non-linear array beneath said floor with said at least three attachment points thereby defining a plane, said attachment points providing inwardly gripping attachment of said platform to the casing outer surface with at least one of said attachment points being adjustable, whereby said platform is placed upon the casing upper rim and attached to the casing outer surface by means of said inwardly gripping attachment points, thereby providing a work area atop the casing and access to the casing interior by means of said opening.

2. The platform of claim 1 including;

a plurality of stanchions projecting upward from said outer perimeter, said stanchions each having an upper end with a plurality of peripheral guards extending therebetween.

3. The platform of claim 1 including;

a toe board extending around said outer perimeter.

4. The platform of claim 1 wherein;

said outer perimeter defines a circle.

5. The platform of claim 1 wherein;

said opening in said floor is concentric with said floor.

6. The platform of claim 1 including;

a cover plate for said opening.

7. The platform of claim 6 wherein;

said cover plate includes means securing said cover plate over said opening, and means providing for the lifting of said cover plate from said opening.

8. The platform of claim 1 including;

a plurality of means providing for the lifting of said platform.

9. The platform of claim 1 including;

at least two clearance openings providing clearance for lifting means secured to any casing installed beneath said platform.

10. The platform of claim 1 including;

means providing for the rigid and temporary securing of a survey instrument or the like thereto.

11. The platform of claim 1 including;

means providing for the securing of a person located thereupon to said platform.

12. The platform of claim 2 wherein;

said outer perimeter includes a plurality of sockets providing for the removable installation of said stanchions, whereby said stanchions and said peripheral guards are removable for compact storage.

13. The platform of claim 1 including;

at least one recess in said perimeter, said recess providing access to said platform.

14. A method of use for a temporarily installable and removable work and safety platform for use with a manhole casing having an upper rim, said platform including a floor having an outer perimeter, said floor including an opening for access to the interior of said casing, said platform including at least three attachment points beneath said floor, said attachment points providing attachment of said platform to said casing with at least one of said attachment points being adjustable, the method comprising;

lifting said platform and placing said platform atop said casing upper rim, positioning two said attach points in contact with the surface of said casing, adjusting said adjustable attachment point to tightly secure said platform to said casing, lifting said casing with said platform secured thereupon and installing said casing as desired, using said platform as required, and loosening said adjustable attachment point and removing said platform from said casing.

* * * * *